US012383046B2

(12) United States Patent
Ripley

(10) Patent No.: US 12,383,046 B2
(45) Date of Patent: Aug. 12, 2025

(54) DRINKING BOTTLE AND METHOD OF DRINKING

(71) Applicant: BOXING CLEVER (LONDON) LTD., Sittingbourne (GB)

(72) Inventor: Lena Ripley, Sittingbourne (GB)

(73) Assignee: BOXING CLEVER (LONDON) LTD, Sittingbourne (GB)

( * ) Notice: Subject to any disclaimer, the term of this patent is extended or adjusted under 35 U.S.C. 154(b) by 0 days.

(21) Appl. No.: 17/616,532

(22) PCT Filed: Jun. 5, 2020

(86) PCT No.: PCT/GB2020/051379

§ 371 (c)(1),
(2) Date: Dec. 3, 2021

(87) PCT Pub. No.: WO2020/245610

PCT Pub. Date: Dec. 10, 2020

(65) Prior Publication Data

US 2022/0232956 A1 Jul. 28, 2022

(30) Foreign Application Priority Data

Jun. 7, 2019 (GB) ..... 1908211

(51) Int. Cl.
*A45F 3/18* (2006.01)
*B65D 23/10* (2006.01)

(52) U.S. Cl.
CPC ..... *A45F 3/18* (2013.01); *B65D 23/108* (2013.01)

(58) Field of Classification Search
CPC ..... B65D 23/104; B65D 23/108; B65D 2501/24426; B65D 2501/24433;
(Continued)

(56) References Cited

U.S. PATENT DOCUMENTS 1,439,588 A 12/1922 Warner
3,275,366 A * 9/1966 Hidding ..... B65D 23/108 215/396

(Continued)

FOREIGN PATENT DOCUMENTS

CN 202890980 U 4/2013
CN 103930003 A 7/2014

(Continued)

OTHER PUBLICATIONS

Search Report for United Kingdom Patent Application No. 1908211.4, mailed Dec. 23, 2019, 7 pages.

(Continued)

*Primary Examiner* — Andrew T Kirsch
(74) *Attorney, Agent, or Firm* — Withrow + Terranova, PLLC; Vincent K. Gustafson

(57) ABSTRACT

A drinking bottle, a drinking system and a method of drinking are provided. The drinking bottle comprises: a container for containing liquid therein; a handle for lifting the container; and a coupling mechanism rotatably coupling the handle to the container; wherein the coupling mechanism is arranged to provide limited rotation of the handle relative to the container between a first position in which the handle extends above the container, and a second position in which the handle is rotated to extend out to the side of the container; and wherein the handle is formed of a resilient material and is arranged to substantially maintain its shape during use so that the container depends from a distal end thereof.

3 Claims, 14 Drawing Sheets

(58) Field of Classification Search
CPC ..... B65D 2401/24439; B65D 2501/24484; B65D 2501/24496; B65D 2501/24503; A45F 3/18
See application file for complete search history.

(56) References Cited

U.S. PATENT DOCUMENTS

| | | | | |
|---|---|---|---|---|
| 4,852,762 | A | 8/1989 | Chou-Sheng | |
| D309,237 | S | 7/1990 | Kobayashi et al. | |
| D325,494 | S | 4/1992 | Gentry | |
| D334,870 | S | 4/1993 | Griffin | |
| D344,413 | S | 2/1994 | Bedrosian et al. | |
| 5,326,006 | A | 7/1994 | Giard, Jr. | |
| D353,520 | S | 12/1994 | Schwartz | |
| 5,413,261 | A | 5/1995 | Wu | |
| 5,545,315 | A | 8/1996 | Lonneman | |
| D379,119 | S | 5/1997 | Wolfe et al. | |
| D379,742 | S | 6/1997 | Enomoto et al. | |
| 5,667,265 | A | 9/1997 | Gebhard | |
| 5,680,944 | A * | 10/1997 | Rueter | B65D 81/3886 150/901 |
| D391,448 | S | 3/1998 | Winer et al. | |
| 5,752,732 | A * | 5/1998 | Beaton | B65D 23/104 294/169 |
| 5,823,385 | A * | 10/1998 | Cautereels | B65D 23/106 220/762 |
| D409,371 | S | 5/1999 | Adams | |
| 6,401,993 | B1 | 6/2002 | Andrino | |
| D622,954 | S | 9/2010 | Porter-Young | |
| D627,594 | S | 11/2010 | Boonprasop | |
| 7,975,887 | B1 | 7/2011 | Esposito | |
| 8,051,674 | B2 | 11/2011 | Roth et al. | |
| D688,522 | S | 8/2013 | Pablo | |
| D760,027 | S | 6/2016 | Meyers et al. | |
| D786,018 | S | 5/2017 | Willows et al. | |
| D810,510 | S | 2/2018 | Serruya et al. | |
| D838,139 | S | 1/2019 | Cudworth | |
| D839,051 | S | 1/2019 | Potter et al. | |
| D850,207 | S | 6/2019 | Peng | |
| D865,447 | S | 11/2019 | Meyers et al. | |
| D878,155 | S | 3/2020 | Peng | |
| D907,955 | S | 1/2021 | Massucco et al. | |
| D924,631 | S | 7/2021 | Gui | |
| D930,438 | S | 9/2021 | Zhang | |
| D948,284 | S | 4/2022 | Bruner | |
| D963,413 | S | 9/2022 | Egorov et al. | |
| D982,974 | S | 4/2023 | Kaytas et al. | |
| D990,983 | S | 7/2023 | Wang | |
| 2002/0084240 | A1 | 7/2002 | Yu-Hsien | |
| 2006/0037931 | A1 * | 2/2006 | Hahn | B65D 23/10 215/398 |
| 2008/0099424 | A1 | 5/2008 | Chalekian et al. | |
| 2008/0245763 | A1 | 10/2008 | Chalekian et al. | |
| 2014/0131230 | A1 | 5/2014 | Steininger | |
| 2016/0121157 | A1 | 5/2016 | Belmore | |
| 2016/0200486 | A1 | 7/2016 | Meyers et al. | |
| 2017/0367536 | A1 | 12/2017 | Wall | |
| 2018/0020814 | A1 | 1/2018 | Pasinski | |
| 2018/0050844 | A1 | 2/2018 | Hirst et al. | |
| 2018/0279815 | A1 | 10/2018 | Hakim | |
| 2018/0362221 | A1 | 12/2018 | Hooks | |
| 2019/0029469 | A1 | 1/2019 | Jones | |

FOREIGN PATENT DOCUMENTS

| | | | |
|---|---|---|---|
| CN | 104812679 | A | 7/2015 |
| CN | 306409368 | | 3/2021 |
| CN | 307356594 | | 5/2022 |
| CN | 307356597 | | 5/2022 |
| CN | 307788470 | | 1/2023 |
| CN | 308012093 | | 5/2023 |
| CN | 308032065 | | 5/2023 |
| CN | 308062160 | | 6/2023 |
| CN | 308154814 | | 8/2023 |
| CN | 308171438 | | 8/2023 |
| CN | 308259389 | | 10/2023 |
| EP | 1094927 | A1 | 5/2001 |
| GB | 6103249 | | 10/2020 |
| JP | S59106426 | U | 7/1984 |
| WO | 2018236646 | A1 | 12/2018 |

OTHER PUBLICATIONS

International Search Report and Written Opinion for International Patent Application No. PCT/GB2020/051379, mailed Sep. 14, 2020, 10 pages.

First Office Action for Chinese Patent Application No. 202080041214.7 mailed Apr. 28, 2024 (8 pages, plus machine translation).

Ali Express, "High Quality 5.7cm Car Dent Puller Body Paneldent Puller Suction Cup Ventouse, Suction Cup Is Suitable for Small Dents in Cars," retrieved Oct. 31, 2023 from the Internet: [URL: https://www.aliexpress.us/item/3256804103189067.html?gatewayAdapt=glo2usa4itemAdapt], (Year: 2023), 4 pages.

Asobu, "asobu 1 Gallon Non-Breakable Shock Resistant Freezable Tritan Jumbo Water Jug Large Capacity with Easy Grip Handle and Pop up Straw Dishwasher safe Bottle," retrieved Oct. 31, 2023 from the Internet: [URL: https://www.amazon.com/asobu-Non-Breakable-Resistant-Freezable-Dishwasher/dp/B0B71 SPSMV?th= 1, (Year: 2022), 8 pages.

Design Inc., "Fraqua," retrieved Oct. 6, 2023 from the Internet: [URL: https://web.archive.org/web/20210622124931/https://www.designinc.co.uk/portfolio/boxing-clever/], (Year: 2021), 4 pages.

Healthy Human Store, "Healthy Human Flip N Sip Lid," retrieved Oct. 31, 2023 from the Internet [URL: https://www.amazon.com/Healthy-Human-FLIP-SIP-Stein/dp/B01 ND1 BG60], (Year: 2017), 7 pages.

MiiR, "Narrow Mouth Lid," Retrieved Oct. 31, 2023 from the Internet: [URL: https://www.miir.com/products/narrow-mouth-lid?variant=40406378020938], (Year: 2023), 5 pages.

Qboyi, "Qboyi Advanced Ergonomic 5 Gallon Water Bottle Handle," Retrieved Oct. 31, 2023 from the Internet: [URL: https://www.amazon.com/Advanced-Ergonomic-Gallon-Bottle-Handle/dp/B0949F4TLQ], (Year: 2020), 6 pages.

Ring TV, "Revolutionary Water Bottle by Fraqua is the First to be Licensed by IBA," retrieved Oct. 6, 2023 from the Internet: [URL: https://www.ringtv.com/638989-revolutionary-water-bottle-by-fraqua-is-the-first-to-be-licensed-by-iba/], (Year: 2023), 7 pages.

Zak!, "Zak! Leak-Proof Water Bottle 64 oz. (1892ml)," Retrieved Oct. 31, 2023 from the Internet: [URL: https://www.ebay.com/itm/134755038604], (Year: 2023), 2 pages.

* cited by examiner

DRINKING BOTTLE AND METHOD OF DRINKING

This application is a 35 U.S.C. § 371 national phase filing of International Application No. PCT/GB2020/051379, filed on Jun. 5, 2020, and claims the benefit of United Kingdom Patent Application No. 1908211.4, filed on Jun. 7, 2019, wherein the entire contents of the foregoing applications are hereby incorporated by reference herein.

The invention relates to a drinking bottle and a method of drinking, particularly to a drinking bottle that is easy for a user with limited or reduced dexterity to drink from.

Drinking bottles such as sports bottles are commonly known. The form of drinking bottles is broadly dictated by their purpose: they must contain a reasonable volume of liquid and must be hand-held. As a result, typical drinking bottles have a substantially cylindrical shape with a diameter narrow enough to be gripped by a hand but wide enough to contain a reasonable volume of liquid. Typical drinking bottles include a container in which the liquid is contained, and a lid that seals the liquid within the container and enables the user to access the liquid for drinking, either by removing the lid or through a suction valve mechanism formed in the lid.

In some instances it can be difficult for certain users to drink from conventional drinking bottles. For example, users with limited or reduced dexterity may have difficulties in holding the drinking bottle and/or applying the required grip strength needed to lift the bottle. In such circumstances it is often necessary for another person to aid the user in drinking, such as by holding and operating the bottle for the user. This can be challenging and can cause the user to drink less frequently, causing issues such as dehydration.

Viewed from a first aspect, the present invention provides a drinking bottle, comprising: a container for containing liquid therein; a handle for lifting the container; and a coupling mechanism rotatably coupling the handle to the container; wherein the coupling mechanism is arranged to provide limited rotation of the handle relative to the container between a first position in which the handle extends above the container, and a second position in which the handle is rotated to extend out to the side of the container; and wherein the handle is formed of a resilient material and is arranged to substantially maintain its shape during use so that the container depends from a distal end thereof.

The coupling mechanism therefore only permits the handle to rotate relative to the bottle within a predetermined range. The first and second positions may be the extreme thresholds of the predetermined range, and the handle may not be able to rotate beyond those thresholds. The coupling mechanism therefore prevents rotation of the handle beyond the first and second position.

The handle is formed of a sufficiently resilient material that the container depends or hangs from a distal end thereof. Thus, the handle may substantially maintain its shape regardless of the orientation of the handle relative to the bottle and/or regardless of whether the user is lifting the bottle by the handle such that the bottle is suspended by the handle. The handle may therefore be used to hold the container e.g. if the handle is oriented substantially horizontally. Thus, the handle may be used to re-orient the container e.g. by reorientation of the handle. Put another way, the position of the handle relative to the container may be substantially fixed but for the rotation of the handle relative to the container provided by the coupling mechanism. For example, the user may be able to re-orient the container from a substantially upright/vertical orientation to an orientation in which the container is tilted by using the handle. This re-orientation is able to occur even while the bottle is suspended by the handle, due to the resilience of the material of the handle.

Since the amount of rotation of the handle relative to the container is limited by the coupling mechanism, and the handle is sufficiently resilient to enable the bottle to be re-oriented using the handle, the drinking bottle provides a means for a user to drink while requiring less dexterity than might otherwise be needed to drink from a known bottle.

For example, the drinking bottle may initially be located on a surface in an upright orientation (so as to hold liquid), with the handle in the first position and therefore extending above the container, e.g. extending vertically upwards. A user can then grip the handle, preferably with their palm facing upwards, and lift the drinking bottle by bending their elbow. As the handle is being lifted and rotated by the user, the handle (which is rotatably coupled to the container) will naturally rotate relative to the container (e.g. by the weight of the container, and by the weight of any liquid therein). The coupling mechanism allows the handle to rotate relative to the container so that the container initially remains upright, but once the handle rotates to the second position (relative to the container), the coupling mechanism prevents further rotation relative to the container. Then, as the user continues to lift and rotate the handle, the container may thereby be tilted from its upright orientation, allowing the user to drink from the container.

The lifting and tilting of the bottle can therefore be enacted entirely by holding, lifting and rotating of the handle, which enables the user to drink from the drinking bottle without needing to hold or grip the container itself. Thus, the resilient material of the handle in combination with the limited amount of relative rotation permitted between the handle and container by the coupling mechanism provides a simplified means for a user to drink, even if they have limited or reduced dexterity in their hands.

Once a user has drunk from the drinking bottle, they may straighten their arm, lowering the container and subsequently causing the container to rotate relative to the handle back to an upright position, and ultimately returning the handle to the first position, in which the handle extends upwards of the container. The bottle will naturally assume its upright position once the handle is no longer in the second position due to the force of gravity acting on the container. The drinking bottle may then be set down again.

Therefore, the handle may be used in the first position to provide an easy grip to pick up the drinking bottle and e.g. to carry the container in an upright orientation, and may be used in the second position to drink from the container by upending it.

The drinking bottle may find particular application in sports such as boxing or other martial arts where large gloves are worn. Such gloves typically reduce the dexterity of a wearer's hands significantly, to the point that the wearer must often rely on another person to help them drink. Indeed, the image of a boxer, still wearing gloves, drinking from a bottle held by a coach, can be readily conjured to mind. The handle may therefore be sized to receive a sports glove, such as a boxing glove, therein. The handle may therefore be significantly larger than a human hand. The drinking bottle may therefore be a sports bottle.

The bottle may also find particular use by those with limited or reduced dexterity and/or muscle control. For example, someone suffering an injury to their hands, or an illness or disease that causes a lack of control in hands, may be able to drink more easily using the drinking bottle. The drinking bottle may enable such a user to drink unaided. The size of the drinking bottle and the handle can be tailored to the intended user.

For the sake of clarity, it is noted that the container has a natural upright orientation in which a base of the container is below an opening from which a user may drink. That is, the natural orientation is the one in which the container is oriented to contain liquid therein. A typical coffee mug has a natural (upright) orientation, and so too does the container.

The container may have a substantially cylindrical shape. The container may comprise a base portion. The container may comprise a lid, and the lid may be disposed above the base when the container is upright. The lid may seal liquid within the container e.g. within a body of the container. The lid may be removably coupled to the body of the container so as to enable the container to be easily filled with liquid and then re-sealed. The lid may comprise a valve mechanism (e.g. a suction valve mechanism) formed within the lid which may enable the user to drink from the bottle without removing the lid e.g. by sucking on the suction valve.

The container depends or hangs from a distal end of the handle, e.g. when the drinking bottle is in use. The distal end may be an end located away from a central portion of the handle. The handle may comprise two ends (e.g. distal ends), each of which may be coupled (i.e. rotatably coupled) to the container. The first end of the handle may be coupled on an opposite side (e.g. an opposite circumferential side) of the container to the second end of the handle. The handle may be a loop. The loop may have a large width relative to a hand to allow a user to easily insert their hand into the loop and grip the loop. The loop may be large enough to receive a sports glove, such as a boxing glove, therein. The drinking bottle may therefore be a sports bottle. The loop may have a width greater than 15 cm, e.g. between 15 cm and 30 cm. The loop may have a width greater than 16 cm, 17 cm, 18 cm, 19 cm, and 20 cm. The width of the loop may be understood as the diameter of the loop, e.g. if the loop has a substantially circular shape. The loop may have a width (e.g. diameter) greater than 20 cm, e.g. between 20 cm and 25 cm. The width (e.g. diameter) of the loop may be the distance from one side of the loop to the other. The area (e.g. the cross-sectional area) of the loop may be greater than about 175 $cm^2$, e.g. between 175 $cm^2$ and 700 $cm^2$. The area of the loop may be greater than 200 $cm^2$, 225 $cm^2$, 250 $cm^2$, 275 $cm^2$, and/or 300 $cm^2$.

The handle may be sized to receive at least a portion of an 8 ounce, 10 ounce, 12 ounce, 14 ounce, 16 ounce, 18 ounce, and/or 20 ounce boxing glove.

The handle may comprise a flattened portion (e.g. the portion furthest from the container) to make gripping the handle easier. The flattened portion may have a width greater than about 1 cm, e.g. between 1 cm and 5 cm. The flattened portion may have a width greater than 1 cm, 1.5 cm, 2 cm, 2.5 cm, and/or 3 cm.

The container may be sized so that it can be gripped and raised by hand. For example, the container may have a width less than about 12 cm, less than about 11 cm, less than about 10 cm, less than about 9 cm, and/or less than about 8 cm. Alternatively, the container may be too large to easily grip and lift with a single hand.

The first position of the handle is a position in which the handle extends above the container, e.g. extends vertically upwards and/or in an axial direction of the container. In this position, the handle may be easily gripped to enable the user to pick up the drinking bottle, e.g. if the bottle is located on a floor. The first position may also provide a convenient way of carrying the container in an upright orientation.

The second position of the handle is a position in which the handle is rotated to extend out to the side of the container. In the second position the handle may extend substantially perpendicular to the first position, e.g. substantially horizontally and/or substantially perpendicular to the axial direction of the container (e.g. to the height direction). In the second position the handle may project outwards from the container by more than at least 10 cm (e.g. at least 15 cm, 16 cm, 17 cm, 18 cm, 19 cm, or 20 cm) due to the large diameter of the loop. The handle may therefore be held in the second position in an extended position (e.g. projecting horizontally outward from the container) by the coupling mechanism. This enables the handle to be held by the user in all permitted orientations, including in the second position, even when the user is wearing large gloves, e.g. boxing gloves.

The angular distance between the first position and the second position may define a range (e.g. a predetermined and/or permitted range) of rotation of the handle. The range of rotation of the handle relative to the container may be between about 60° and 120°, or between about 70° and 110°, or between about 80° and 100°. The range may be about 90°. The handle may rotate by about 90° between the first position and the second position.

The rotation of the handle may be limited (e.g. restricted) so that the handle does not contact or rest against the container in the first and/or second position. In other words further rotation of the handle beyond the first and/or second position may be prevented by the coupling mechanism itself rather than because the handle is in abutment with the container. Movement of the handle may therefore be unobstructed e.g. between the first position and the second position. Rotation of the handle may be permitted and/or prevented only by the coupling mechanism.

Substantially all movement of the handle relative to the container may be provided by the coupling mechanism. The coupling mechanism may provide only a single degree of freedom for movement of the handle relative to the container e.g. rotation in a single direction. The handle may rotate relative to the container only about a single axis. The axis may be orthogonal to the axis of the container. The coupling mechanism may be arranged below the top, e.g. below the lid, of the container.

In some examples, the handle is not coupled to the lid of the container. The container can therefore be refilled via removal of the lid without requiring removal of the handle and coupling mechanism. The lid may be attachable to the container in order to secure the coupling mechanism and handle to the container.

In other examples, the handle is coupled to the lid of the container. In this example, since the coupling mechanism may only allow rotation of the handle in a single direction, and since the handle is formed of a resilient material, the handle can also be used to unscrew the lid e.g. while wearing gloves. For instance, a user may grip the handle and apply a torque to the handle (i.e. rotate or twist the handle around the axis of the container). Since the coupling mechanism may prevent the handle from freely rotating relative to the lid/container in this direction (i.e. about the axis of the container), the rotational force will be transmitted through the handle to the lid, thus unscrewing the lid. That is, since the coupling mechanism prevents the handle from rotating in any way other than around a single axis of rotation, if the handle is coupled to the lid then the handle can be used to remove the lid. The coupling mechanism may comprise at least one rotation mechanism.

The coupling mechanism may comprise two rotation mechanisms between which the handle extends. The rotation mechanism(s) may be configured to enable the handle to rotate relative to the container. The coupling mechanism may be configured to enable the handle to rotate relative to the container only in a single direction.

The rotation mechanism(s) may be fixed to an annular member that is arranged on the container. The annular member may be a collar arranged about the container. The collar may be sized in correspondence with the size of the container. For instance the collar may have an inner diameter that is substantially equal to an outer diameter of the container to prevent or reduce relative movement between the collar and the container, e.g. relative movement in a radial direction of the container and/or a direction perpendicular to the axis of the container. The collar may have an inner diameter that is larger (e.g. slightly larger) than an outer diameter of a first portion of the container and smaller than an outer diameter of a second portion of the container. Thus the collar may be fitted over the first portion of the container and abut the second portion of the container so as to be seated thereon. The collar may be held in place by the lid e.g. by attachment of the lid to the container.

At least one rotation mechanism may comprise a first rotation portion fixed relative to the container (e.g. during use) and a second rotation portion fixed relative to the handle. The first rotation portion may be fixed to the container so that it is unable to rotate relative to the container around the axis about which the handle rotates between the first position and the second position, e.g. an axis orthogonal to the axis of the container. The first rotation portion may be able to rotate around the axis of the container. For example the first rotation portion may be fixed to or integral with a collar about the container and the collar may be able to rotate around the axis of the container. The collar may be prevented or inhibited from rotating about the axis of the container by friction, e.g. by friction caused by the application of a force on the collar by the lid. Thus the first rotation portion may be fixed relative to the container.

The first rotation portion may be fastened to the second rotation portion so as to be rotatable thereto, e.g. by a fastener. The first and second rotation portions may be coupled/fastened together in such a way that does not prevent the rotation portions from rotating relative to each other, but that prevents other types of relative movement, e.g. axial, radial, and/or circumferential movement (wherein axial, radial and circumferential directions may be defined with reference to the container). The fastener may be a screw, a rivet, or any other suitable fastening.

The coupling mechanism that couples the handle to the collar and/or container (including e.g. the fastener that fastens the first rotation portion to the second rotation portion) may enable control over how easily the handle rotates relative to the container. For example the fastener may comprise a tensioning mechanism such that tightening of the fastener may decrease the ease with which the handle rotates relative to the container, and/or loosening of the fastener may increase the ease with which the handle rotates relative to the container. The first and second rotation portions may be configured such that they can rotate relative to each other within the permitted rotation range and are prevented from rotating relative to each other beyond the permitted rotation range.

Both rotation mechanisms may comprise a first and second rotation portion. The rotation mechanism(s) may be configured to limit/restrict the rotation of the handle relative to the container. In one example the first and second rotation portions may each comprise a respective abutment portion. The respective abutment portions may be rotated into contact when the handle is rotated to the threshold or limit of rotation, e.g. rotated to at least one of the first and second position. Contact of the abutment portions may therefore prevent rotation of the handle beyond the first and/or second position.

The abutment portions of the first and second rotation portion may each comprise a first and second abutment surface. The respective first abutment surfaces of the first and second rotation portions may be in contact in the first position, and the respective second abutment surfaces of the first and second rotation portions may be in contact in the second position. Therefore, contact of the respective first abutment surfaces may prevent rotation of the handle beyond the first position and contact of the respective second abutment surfaces may prevent rotation of the handle beyond the second position. The abutment portions and/or abutment surfaces may not be in contact when the handle is orientated between the first and second position.

Each rotation mechanism may comprise a bearing. The bearing may be located between the first rotation portion and the second rotation portion. The bearing may enable the first rotation portion to easily rotate relative to the second rotation portion.

The mass of the container may be sufficient to effect rotation of the container by the coupling mechanism. That is, when the drinking bottle is lifted by the handle, the container may stay substantially upright while the handle is rotated between the first and second position, even if the container is empty. When the container is filled with liquid, a greater moment will be exerted about the coupling mechanism due to the greater mass of the filled container and so rotation of the container relative to the handle will be easier. Thus no extra force may need to be applied by the user to cause the handle to rotate from the first position to the second position and/or from the second position to the first position.

The drinking bottle may be formed of any suitable material, such as metal plastic, ceramics, and so on. For example, the container may be formed of plastic and/or metal. The container may be heat resistant and/or thermally stable. The container may be an insulator and may be arranged to insulate a temperature of the fluid therein. The handle may be plastic, metal, wood, ceramic and so on, and may be any material sufficiently resilient to operate as herein described. The handle may be an insulator, and the container may not be an insulator, and the handle may therefore serve to insulate a user from temperatures of a fluid within the container. Indeed, the invention may find particular application in circumstances wherein direct handling of container is difficult or dangerous e.g. due to extreme temperatures of its contents.

View from a second aspect, the invention provides a drinking system comprising the drinking bottle described herein with reference to the first aspect of the invention, and a sports glove, wherein the handle is sized to receive at least a portion of the sports glove.

Thus a user wearing the sports glove can easily drink from the drinking bottle without needing to take off the glove. The sports glove may be a boxing glove, a martial arts glove, or any padded glove e.g. for use in contact sports. As discussed above with reference to the first aspect, the handle may be self-supporting as a consequence of being formed of a resilient material, and may therefore be in an upright loop ready to receive a portion of the glove. Viewed from a third aspect, the present invention provides a method of drinking from a drinking bottle, the method comprising: gripping a handle of the drinking bottle and lifting the drinking bottle thereby; rotating the handle relative to a container of the drinking bottle from a first position to a second position; tipping the container using the handle in the second position; and drinking from the container. The method may comprise wearing a sports glove, preferably boxing gloves, while lifting the drinking bottle. The method may comprise inserting at least a portion of the sports glove through the handle to thereby grip the handle while wearing the glove.

Gripping the handle to lift the drinking bottle may comprise orienting a palm of the hand gripping the handle upwards.

The method may comprise drinking from a drinking bottle as described in accordance with the first aspect of the invention. The method may comprise using a drinking system as described above with reference to the second aspect of the invention. Thus the drinking bottle may include any features as described above and the method may include using those features.

The method may be performed without gripping the container. Thus the lifting and/or tipping of the container may be performed only by using the handle. The method may thus include drinking from the bottle without touching the container.

According to the present invention there is provided a container carriage device (e.g. a drinking bottle) comprising a container, and a carrier (e.g. a handle), wherein the carrier is arranged to extend from one or more securement locations (e.g. coupling mechanisms) on the side of the container and one or more securement locations is arranged to enabled the container to rotate with reference the carrier.

The carrier may extend some distance away from the container so as to allow a large loop away from the container during use.

The container may be elongated. The container may comprise a top and a base, wherein the base may comprise a flat or substantially flat bottom surface.

The top may comprise a lid, for example a displaceable lid. And the lid may comprise a valve, spout or pourer. This may be operable by suction only, and may be arranged not to leak when not under suction.

For example the container may comprise a bottle.

In this way the container may be held by the carrier in more than one orientation, such that for example an elongate container may be held for use, and carried for transport.

In some embodiments the carrier is arranged to extend away from the side of the container sufficient to allow for a boxing glove to fit between the container side and the inner surface of the carrier.

For example in use therefore the glove may be passed between the container and the carrier.

In some embodiments the carrier may comprise a strap.

In some embodiments the strap may comprise an adjustment means. This adjustment means is ideally arranged to allow for accommodation between the carrier and the container of a boxing glove, and/or different sizing of boxing gloves.

In some embodiments the adjustment means or carrier may comprise an elastomeric strap or adjustment means.

In such embodiments therefore the carrier may pull down on or against the glove such that insertion of the glove between the carrier and the container subsequently maintains the device on the glove for use.

In some embodiments the adjustment means may comprise a stepped, staged or incremental adjustment means, for example such that a user is enabled to adjust the means before use to make it appropriate.

FIGURES

Preferred embodiments of the present invention will now be described in greater detail, by way of example only and with reference to the accompanying drawings, in which.

DESCRIPTION

Figure 1:
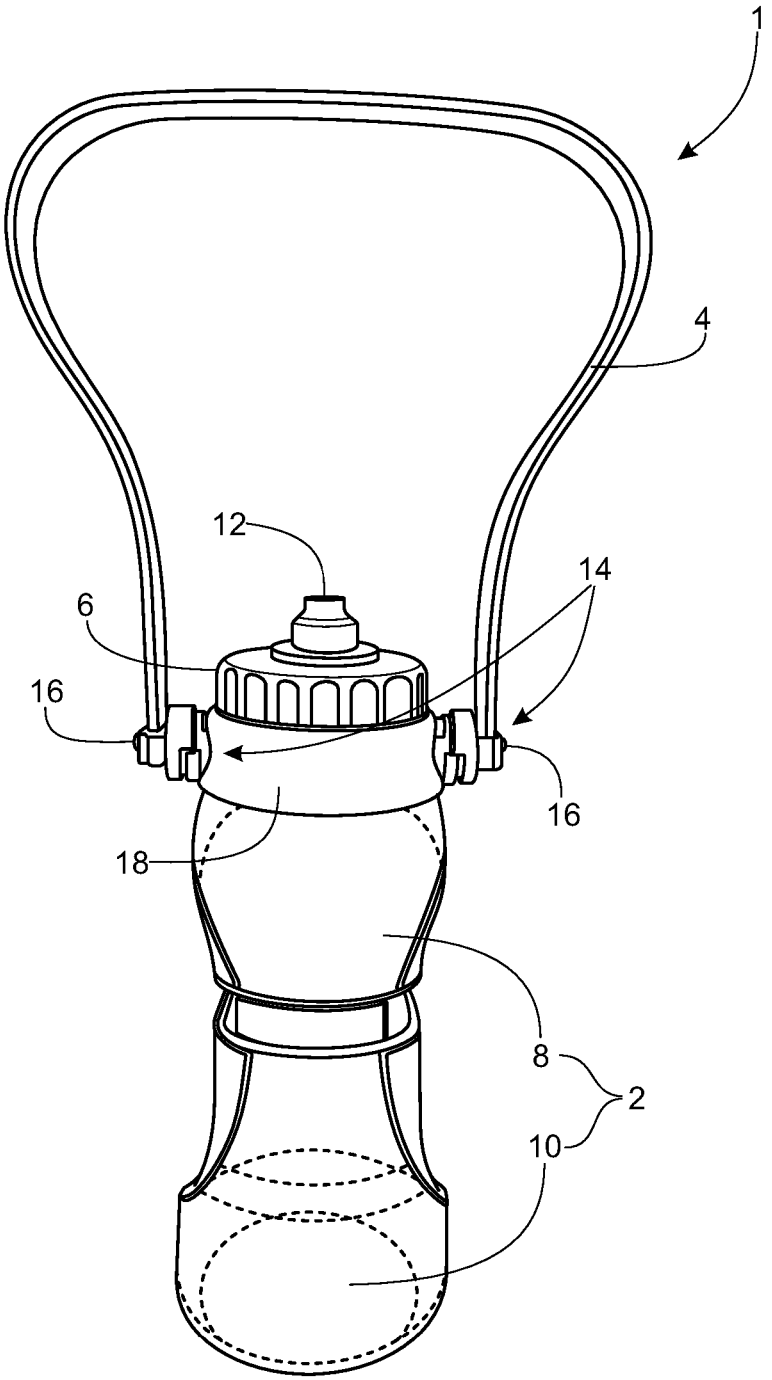
FIG. 1 shows a front view of a drinking bottle with a handle in a first position.

FIG. 1 shows a drinking bottle 1 according to the present invention. The drinking bottle 1 comprises a container 2, a handle 4 and a lid 6. The drinking bottle 1 is in an upright orientation, i.e. an orientation for containing liquid in the container 2. The handle 4 is in a first position in which the handle 4 extends above the container 2.

The container 2 is for containing liquid therein. The container 2 comprises a body 8 and a base 10. The lid 6 is coupled to the container 2 to seal liquid within the container 2. The lid 6 comprises a suction valve mechanism 12 formed within the lid 6 so as to enable a user to drink liquid from the container 2 by applying suction to the lid 6 with their mouth. The base 10 is located below the lid 6 while the container 2 is in the upright orientation. The base 10 of the container 2 is wider than the body 8 so as to provide improved stability of the drinking bottle 1 when located on a surface in the upright orientation.

The handle 4 is rotatably coupled to the container 2 by a coupling mechanism 14. The coupling mechanism 14 comprises two rotation mechanisms 16 located on opposing circumferential sides of the container 2. The handle 4 extends between the rotation mechanisms 16 and forms a loop. The handle 4 is formed of a resilient material and thus, as shown, it holds its shape while in the first position. The handle 4 is therefore ready to receive a portion of a hand or glove therethrough.

The rotation mechanisms 16 are fastened to a collar 18 which is arranged around the container 2. The collar 18 is held in place by the lid 6. The rotation mechanisms 16 will be described in more detail later.

Figure 2B:
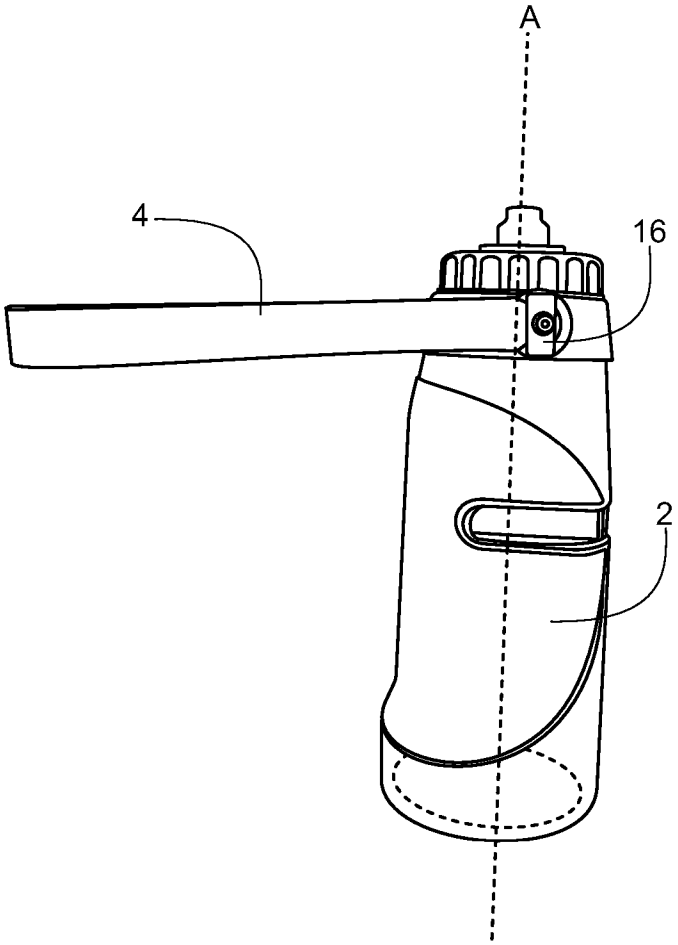
FIG. 2B shows a side view of the drinking bottle with the handle in a second position.
Figure 2A:
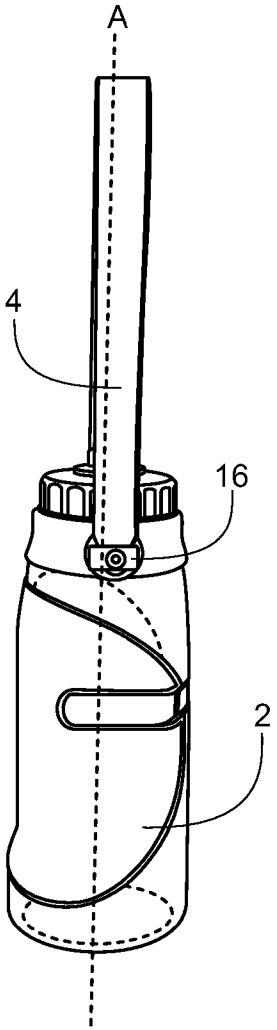
FIG. 2A shows a side view of the drinking bottle of FIG. 1.

FIGS. 2A and 2B show the drinking bottle 1 with the handle 4 in two different orientations. FIG. 2A shows the handle 4 in the first position in which the handle extends above the container 2. FIG. 2B shows the handle 4 in a second position in which the handle 4 is rotated to extend out to the side of the container 2. The handle 4 can be moved between the first and second positions by rotation of the handle 4. This rotation is permitted and limited by the coupling mechanism 14 (e.g. by the rotation mechanisms 16). The handle 4 is permitted to rotate around an axis which is orthogonal to an axis A of the container 2.

The first and second positions of the handle 4 depicted in FIGS. 2A and 2B are extreme orientations, i.e. they show the handle 4 at its limits of rotation. As shown, the difference in orientation of the handle 4 between FIG. 2A and FIG. 2B is about 90 degrees. Thus the range of rotation in this example is restricted to about 90 degrees.

The rotation of the handle 4 is limited because of the configuration of the coupling mechanism 14, and specifically the rotation mechanisms 16. Each rotation mechanism 16 comprises a first rotation portion 16*a* and a second rotation portion 16*b*. These will be described in more detail below. For illustrative purposes, the configuration of the rotation mechanisms 16 will be described first by showing the rotation mechanisms 16 when the drinking bottle 1 is in a disassembled state, in which the handle 4 is not coupled to the container 2, and then by showing the rotation mechanisms 16 when the drinking bottle 1 is in an assembled state, in which the handle 4 is coupled to the container 2.

Figure 3:
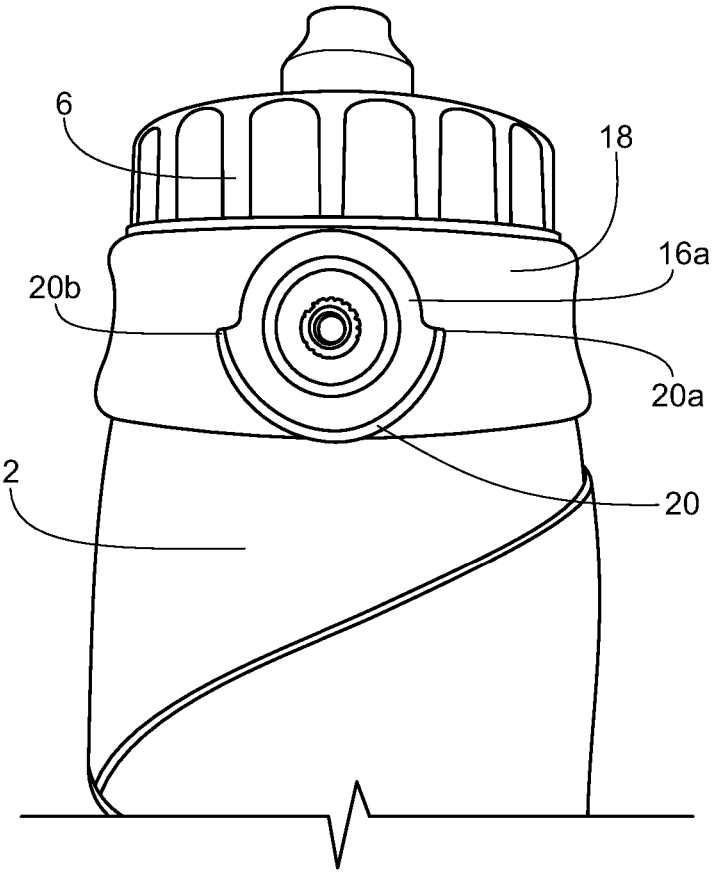
FIG. 3 shows a disassembled view of a coupling mechanism showing a first rotation portion.

FIG. 3 shows the first rotation portion 16*a* of one of the rotation mechanisms 16 of the drinking bottle 1 when the handle 4 has been removed (i.e. when the handle 4 is not coupled to the drinking bottle 1). The first rotation portion 16*a* is fixed to the collar 18, and the collar 18 is located around the container 2. The collar 18 is held in place, i.e. prevented from moving axially with respect to the container 2, by the lid 6. The collar 18 may also be prevented or inhibited from rotating in a circumferential direction with respect to the container 2 by friction, e.g. friction caused by the lid sandwiching the collar 18 between the lid 6 and the container 2. Thus, the first rotation portion 16*a* is fixed relative to the container 2.

The first rotation portion 16*a* includes an abutment portion 20. The abutment portion 20 is a protrusion that extends outwards away from the container 2. The first rotation portion 16*a* is substantially circular in shape. The protrusion 20 extends approximately 180 degrees around the circumference of the first rotation portion 16*a*. The abutment portion 20 includes first and second abutment surfaces 20*a*, 20*b*, located at each end of the abutment portion 20 respectively. As will be described in more detail later, the interaction of the abutment portion 20 with a corresponding abutment portion 24 of the second rotation portion 16*b* (shown in FIG. 4A) provides the restriction on the permitted rotation range of the handle 4 relative to the container 2.

Figure 4A:
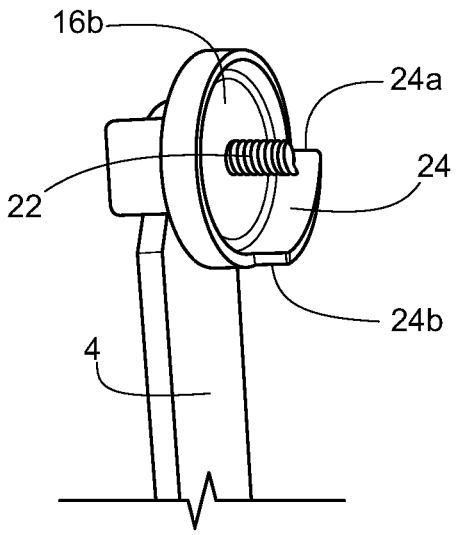
FIG. 4A shows a disassembled view of the handle showing a second rotation portion.

FIG. 4A shows the second rotation portion 16*b* of one of the rotation mechanisms 16 of the drinking bottle 1 when the handle 4 has been removed (i.e. when the handle 4 is not coupled to the drinking bottle 1). The second rotation portion 16*b* is fastened to one end of the handle 4 by a fastener 22, which in this example is a screw.

The second rotation portion 16*b* includes an abutment portion 24. The abutment portion 24 is a protrusion that extends outwards from the handle 4. The second rotation portion 16*b* is substantially circular in shape. The protrusion extends approximately 90 degrees around the circumference of the second rotation portion 16*b*. The abutment portion 24 includes first and second abutment surfaces 24*a*, 24*b*, located at each end of the abutment portion 24 respectively.

Figure 4B:
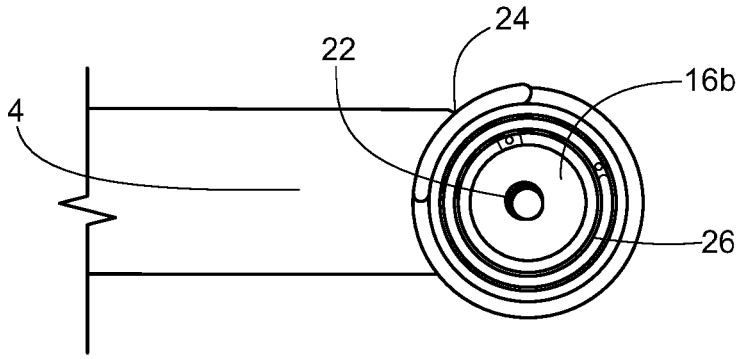
FIG. 4B shows a disassembled view of the handle showing the second rotation portion.

FIG. 4B shows the second rotation portion 16*b* with a bearing 26 located therein. When the drinking bottle 1 is in an assembled state, the bearing 26 is located between the first rotation portion 16*a* and the second rotation portion 16*b* so as to enable easy relative rotation therebetween.

FIGS. 5A, 5B, 6A and 6B show how the coupling mechanism 14, specifically the first and second rotation portions 16*a*, 16*b* of the rotation mechanisms 16, are configured to prevent the handle 4 from being rotated beyond the first and second positions.

Figure 5A:
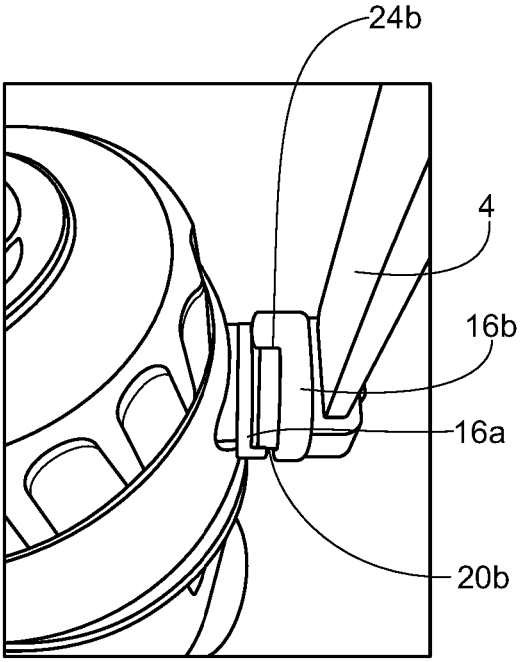
FIG. 5A shows a rotation mechanism while the handle is in the first position.
Figure 5B:
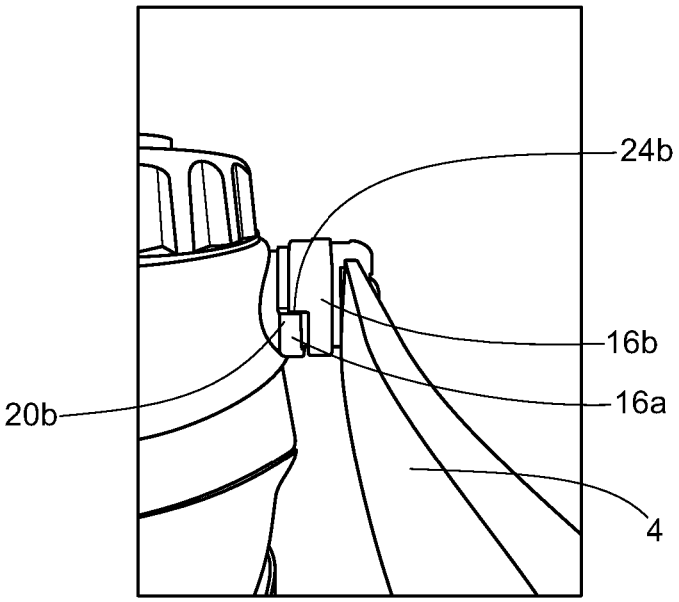
FIG. 5B shows a rotation mechanism while the handle is in the second position.

FIGS. 5A and 5B show the interaction between the first and second rotation portions 16*a*, 16*b* that prevent the handle 4 from being rotated beyond the second position.

In FIG. 5A the handle 4 is in the first position. The second abutment surfaces 20*b*, 24*b* of the respective abutment portions 20, 24 of the first and second rotation portions 16*a*, 16*b* are not in contact, i.e. not in abutment with each other. In FIG. 5B the handle 4 is in the second position. The second abutment surfaces 20*b*, 24*b* of the respective abutment portions 20, 24 of the first and second rotation portions 16*a*, 16*b* are in contact, i.e. in abutment with each other. Thus, rotating the handle 4 from the first position to the second position rotates the second abutment surfaces 20*b*, 24*b* into contact, and further rotation beyond the second position is prevented by the abutment of the second abutment surfaces 20*b*, 24*b*.

Figure 6A:
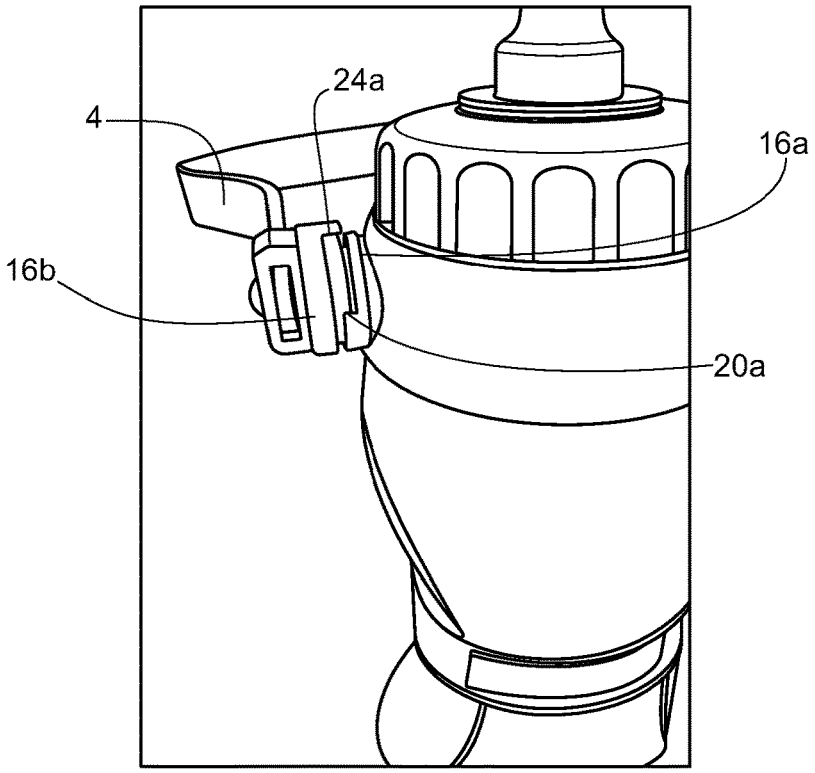
FIG. 6A shows a front view of the coupling mechanism while the handle is in the second position.
Figure 6B:
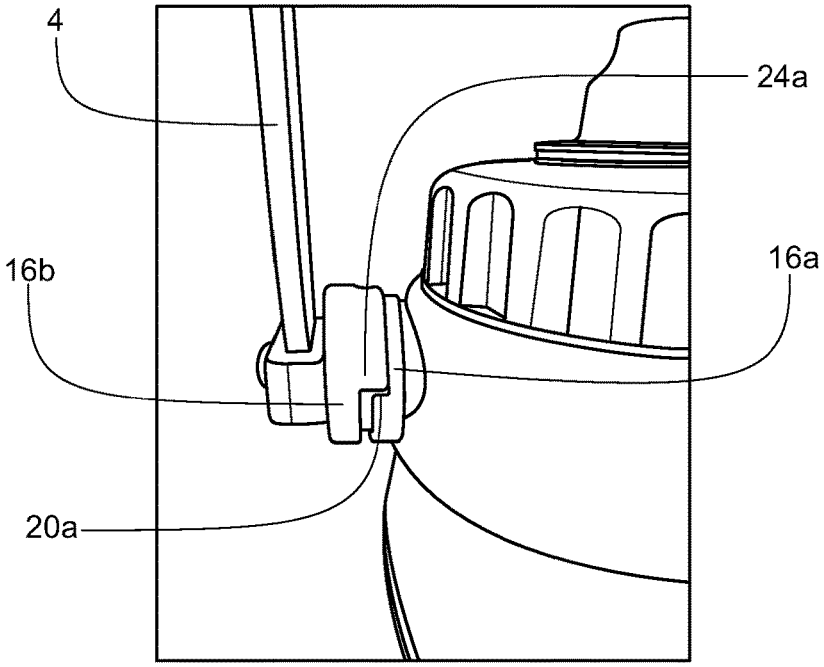
FIG. 6B shows a front view of the coupling mechanism while the handle is in the first position.

FIGS. 6A and 6B show the interaction between the first and second rotation portions that prevent the handle from being rotated beyond the first position.

In FIG. 6A the handle 4 is in the second position. The first abutment surfaces 20*a*, 24*a* of the respective abutment portions 20, 24 of the first and second rotation portions 16*a*, 16*b* are not in contact, i.e. not in abutment with each other. In FIG. 6B the handle 4 is in the first position. The first abutment surfaces 20*a*, 24*a* of the respective abutment portions 20, 24 of the first and second rotation portions 16*a*, 16*b* are contact, i.e. in abutment with each other. Thus, rotating the handle 4 from the second position to the first position rotates the first abutment surfaces 20*a*, 24*a* into contact, and further rotation beyond the first position is prevented by the abutment of the first abutment surfaces 20*a*, 24*a*.

Thus, the abutment portions 20, 24 are rotated into contact when the handle is rotated to the first position and to the second position. In between these positions, the abutment portions 20, 24 are not in contact.

Therefore, as has been described with reference to FIGS. 5A, 5B, 6A and 6B, rotation of the handle 4 relative to the container 2 is limited by the configuration of the abutment portions 20, 24 of the first and second rotation portions 16*a*, 16*b*.

Figure 7A:
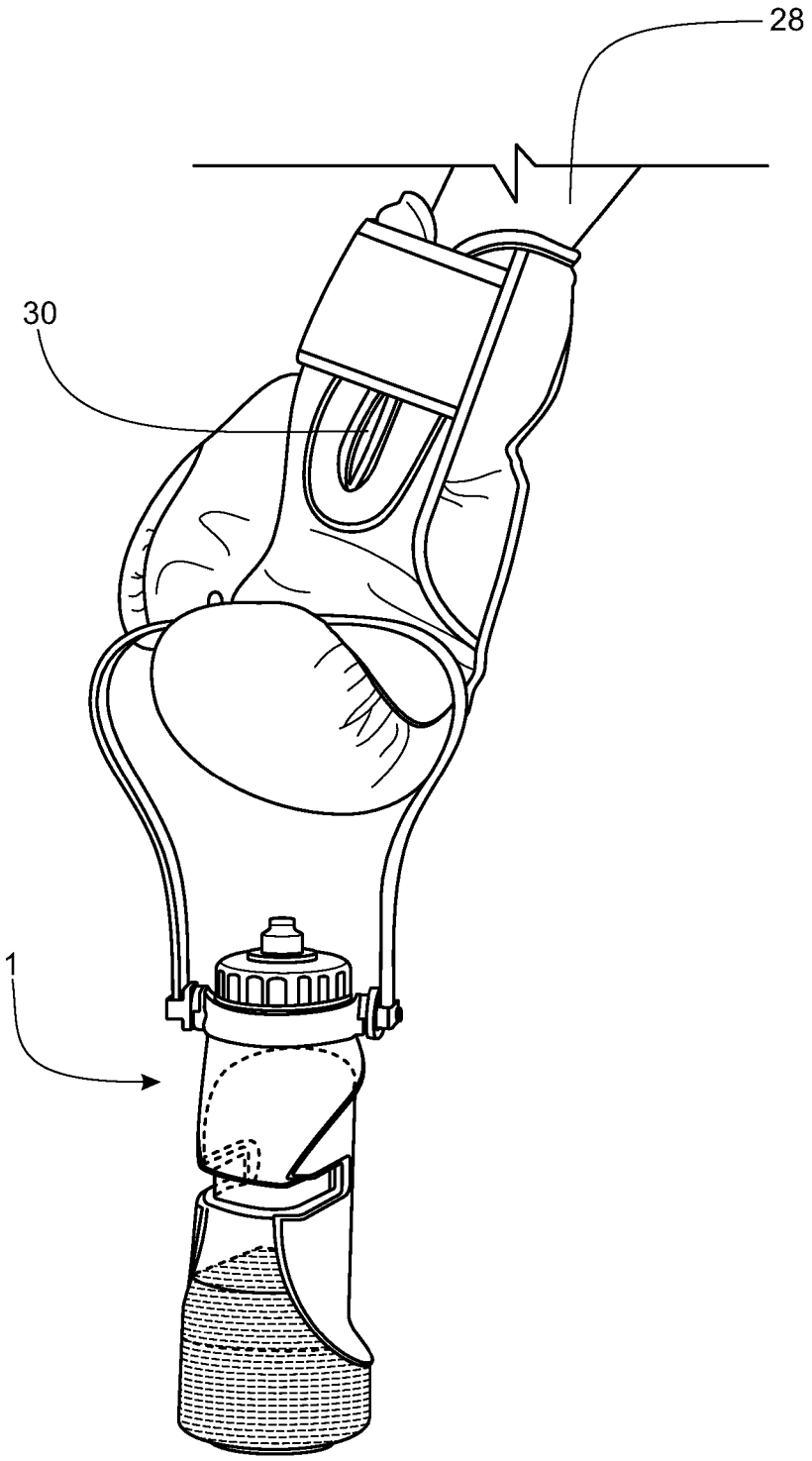
FIG. 7A shows a user gripping the drinking bottle while wearing boxing gloves.
Figure 7B:
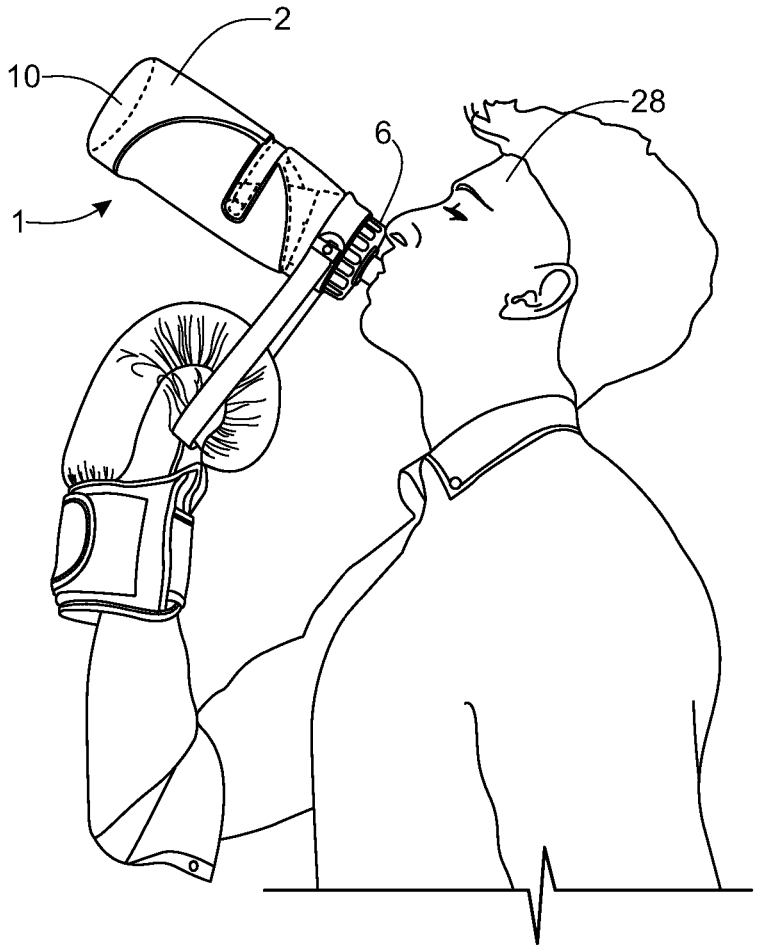
FIG. 7B shows a user drinking from the drinking bottle while wearing boxing gloves.
Figure 8:
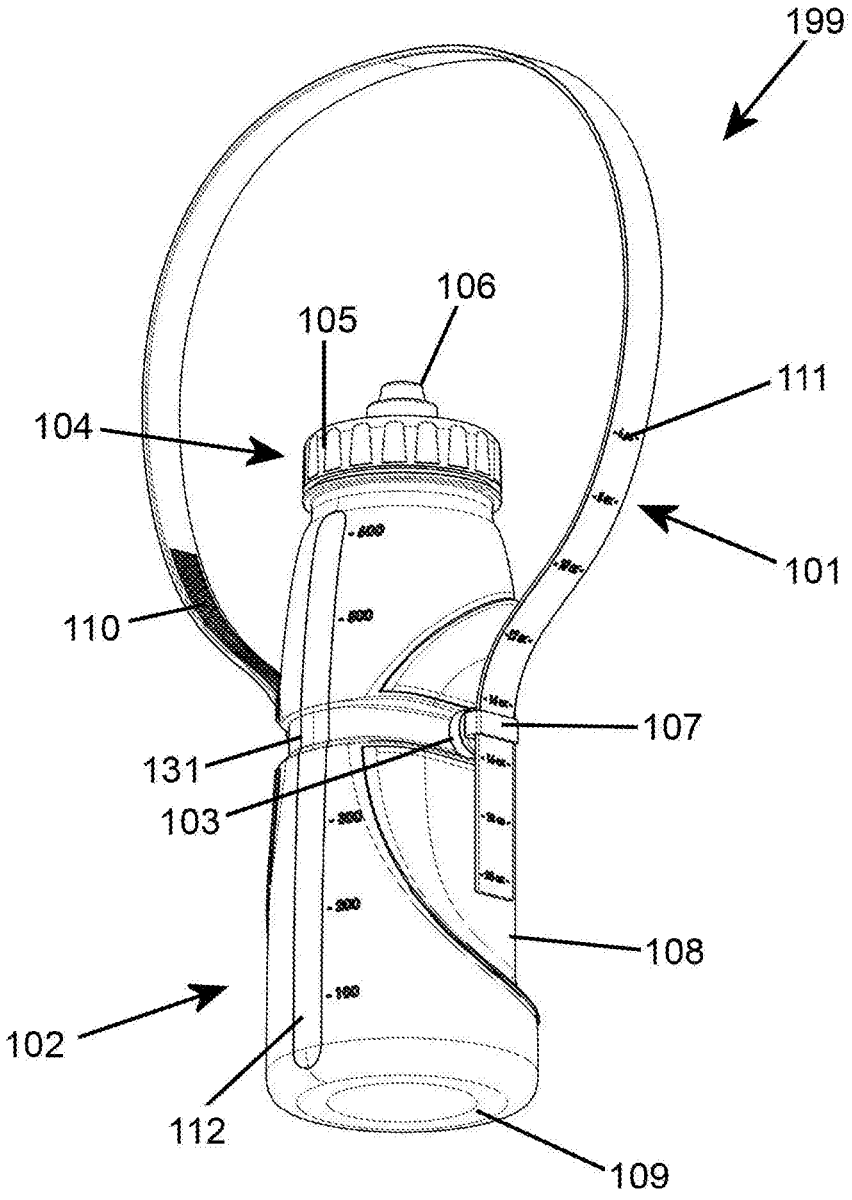
FIG. 8 shows an isometric view of an embodiment of the device according to the present invention with the carrier in an axially extending position.
Figure 9:
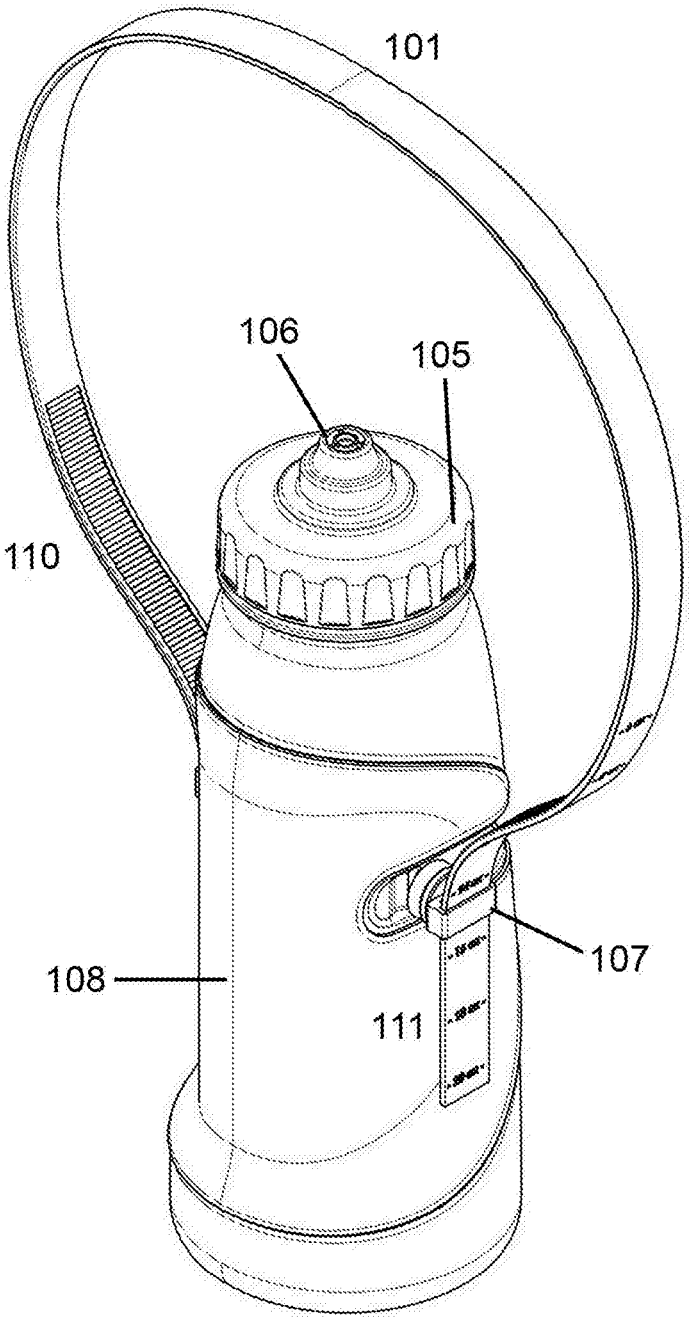
FIG. 9 shows a reverse isometric view of the embodiment of the device as shown in FIG. 8.
Figure 10:
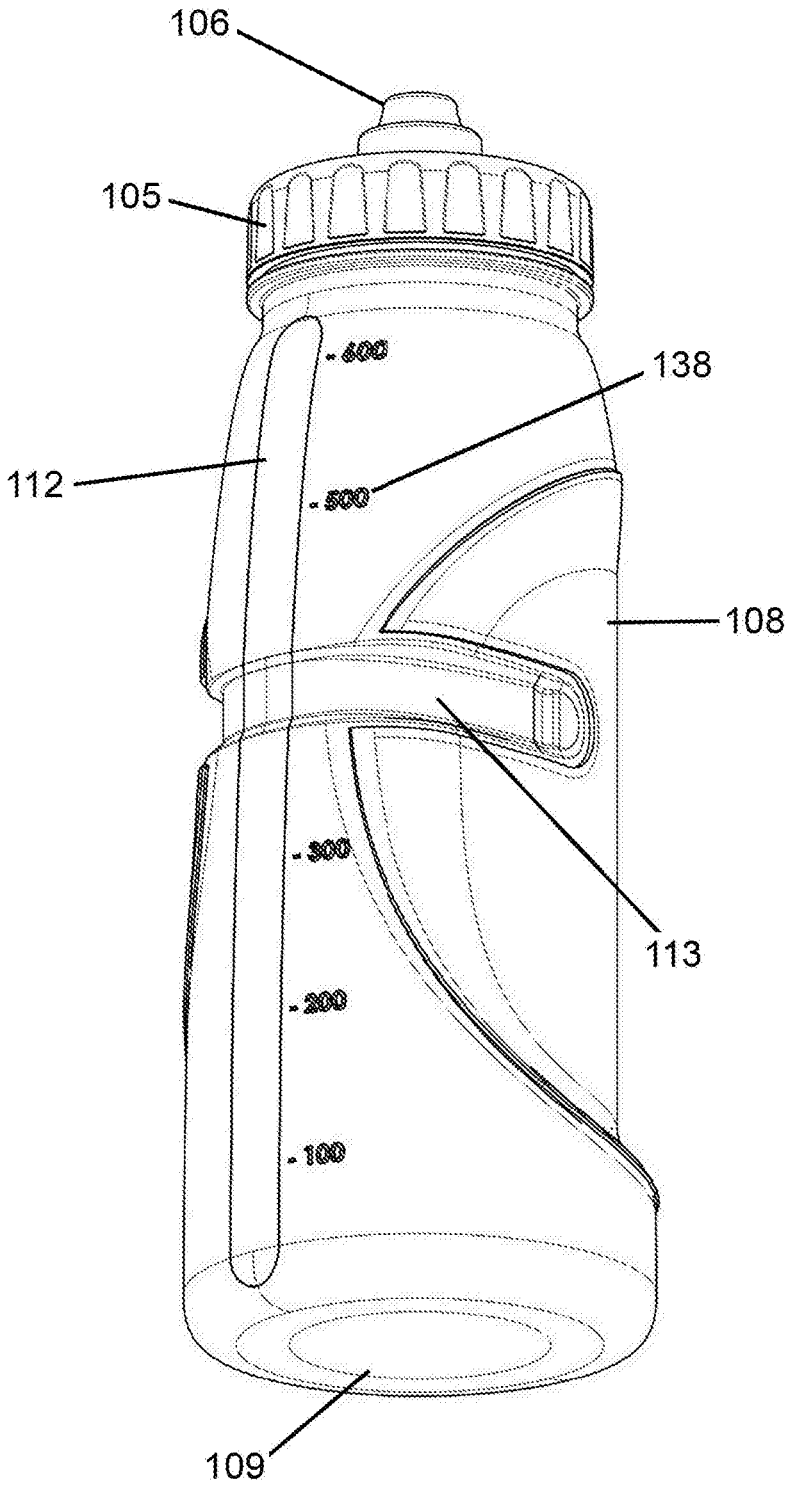
FIG. 10 shows an isometric view of the embodiment of the container of the embodiment of the device as shown in FIG. 8.
Figure 11:
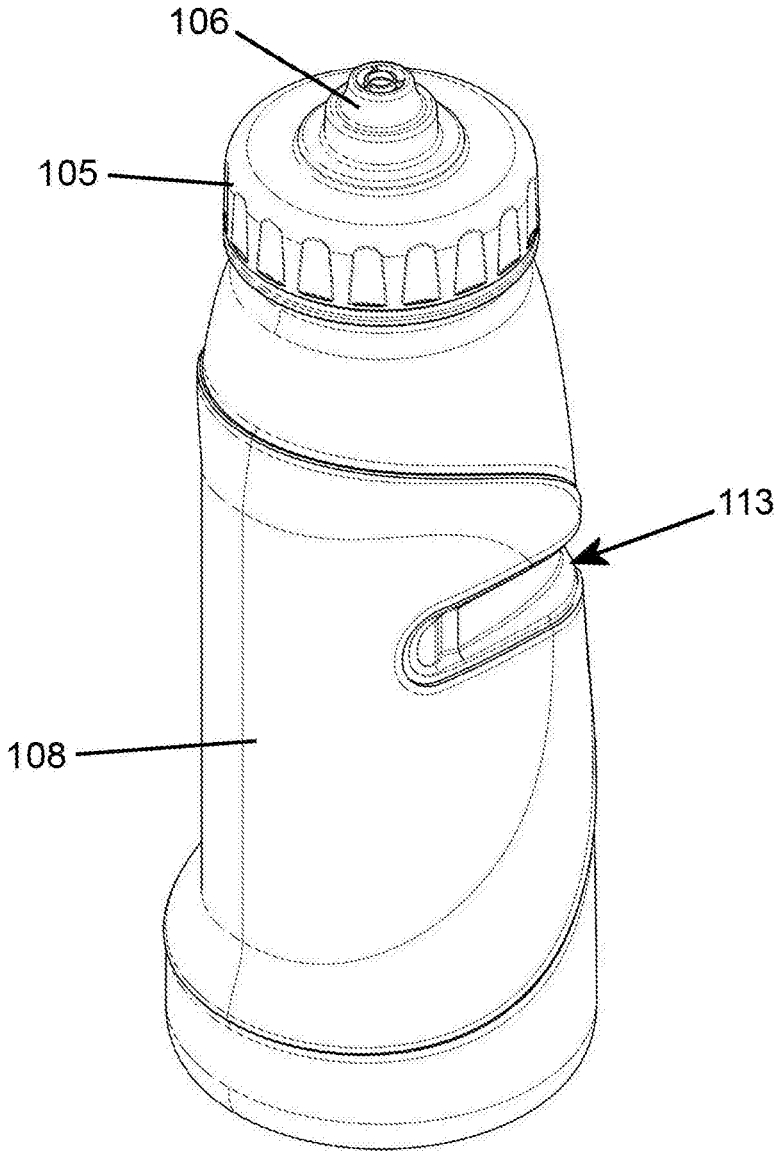
FIG. 11 shows a reverse isometric view of the embodiment shown in FIG. 8.
Figure 12:
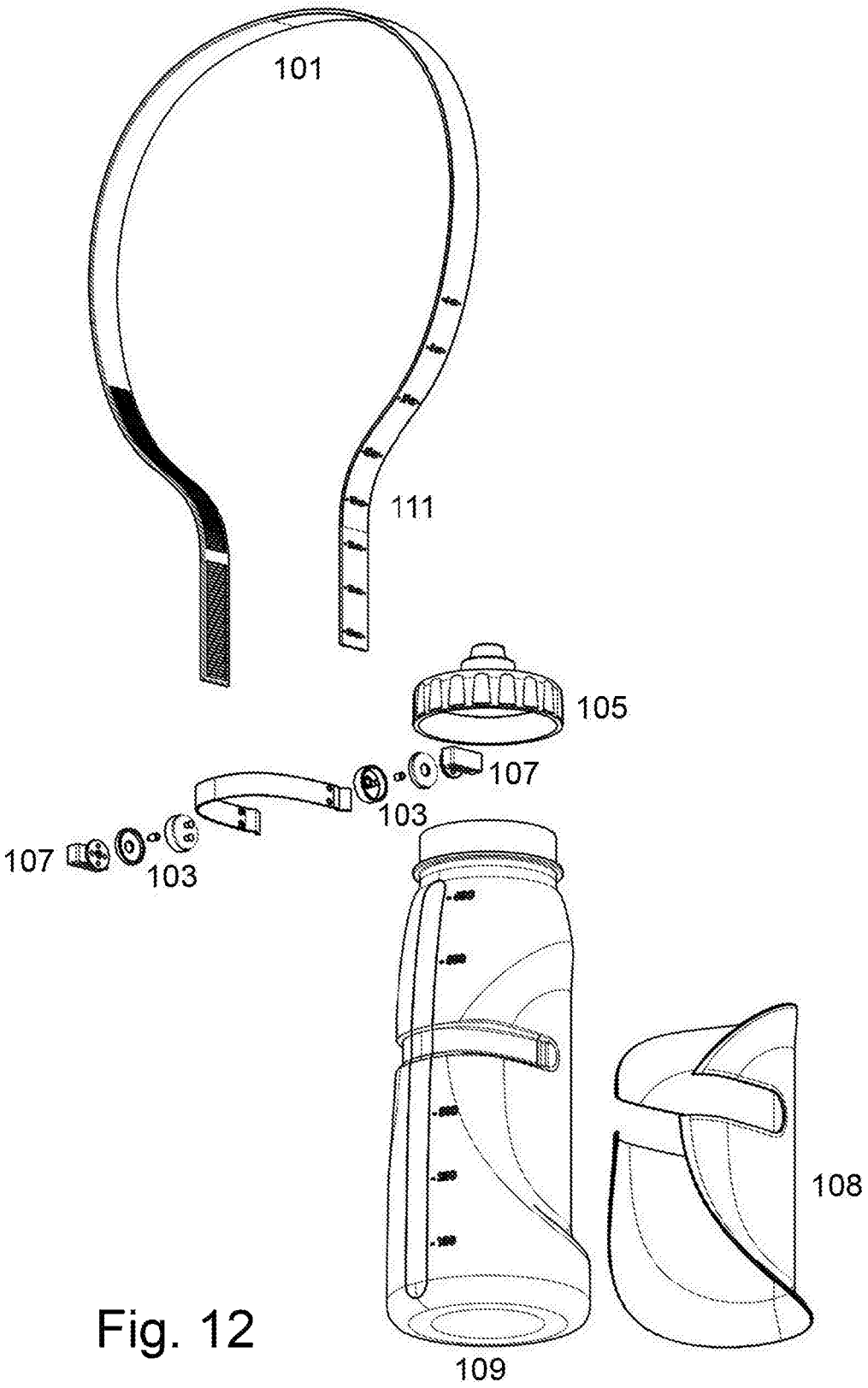
FIG. 12 shows an exploded isometric view of the embodiment of the device shown in FIG. 8.
Figure 13:
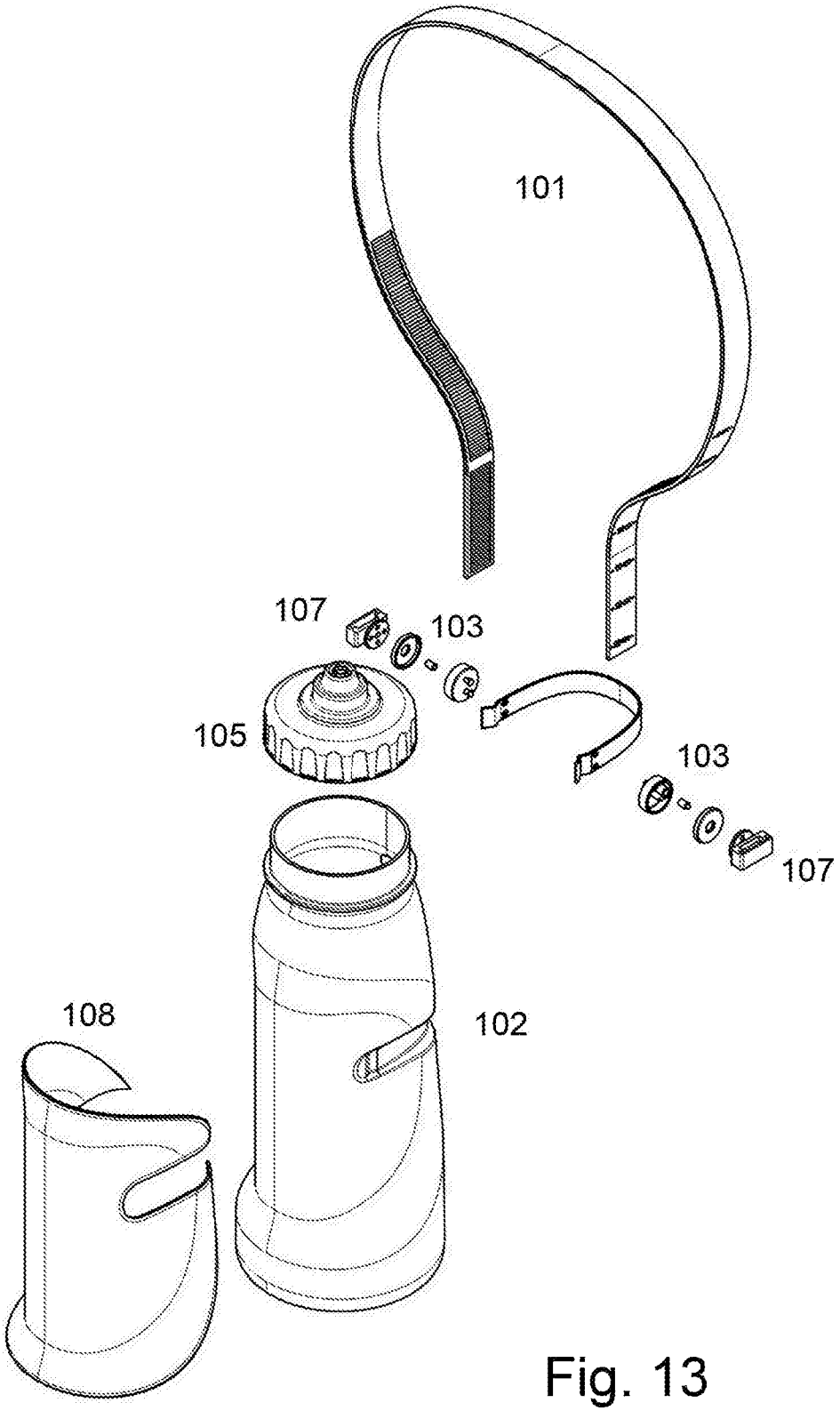
FIG. 13 shows a reverse exploded isometric view of the embodiment of the device shown in FIG. 12.

FIGS. 7A and 7B show how the configuration of the drinking bottle 1 of the present invention enables a user 28 to operate (i.e. drink from) the drinking bottle 1 while wearing a boxing glove 30.

In FIG. 7A, the drinking bottle 1 is located on a surface and the handle 4 is in the first position, extending upwards. The boxing glove 30 is inserted into the loop of the handle 4 by the user 28. The relatively large width of the loop 4 enables the glove 30 to be inserted despite the large size of the glove 30. The user 28 is then able to lift the drinking bottle 1 using the handle 4 while wearing the boxing glove 30, without having to remove the glove 30 to grip the bottle 1.

In FIG. 7B, the container 2 is in a tilted orientation (an upended position in which the base 10 is higher than the lid 6) which allows the user 28 to drink from the drinking bottle 1. The handle 4 is in the second position.

It can be seen that the resilience of the handle 4 means that the handle 4 substantially maintains its shape during use, both in the first position, which allows the user 28 to easily grip the handle 4 even while wearing gloves 30, and in the second position, which (in combination with the limited rotation of the handle 4 provided by the coupling mechanism 14) allows the user 28 to upend the drinking bottle 1 using the handle 4.

The invention therefore provides a drinking bottle with a reconfigurable handle that automatically transitions between a first position and a second position in order to simplify the process of drinking for a user. The rotation of the handle from a position in which the drinking bottle is easy to initially grip (i.e. the first position) to a position in which the drinking bottle can be upended in order to drink (i.e. the second) is achieved automatically as a consequence of the coupling mechanism connecting the handle to the container.

Another drinking bottle 199 will be described herein with reference to FIGS. 8-13.

The present invention relates to a container carriage device, comprising in use a carrier and a container, for example a bottle; more particularly but not exclusively a carrier for a bottle adapted to allow use of the bottle whilst wearing boxing gloves.

Increasing numbers of people in many societies seek enjoyment as well as exercise in boxing or martial arts. It is an effective aerobic exercise regime for both sexes, either in contact or non-contact embodiments.

During all forms of exercise it is always advisable to maintain hydrated for purposes of effective exercise as well as general wellbeing, replacing lost fluids.

However it can be problematic, particularly when partaking in boxing exercise, to maintain hydrated, on account particularly of the boxing gloves where these are being worn.

These will make it very difficult to manipulate or hold or carry water bottle or containers or this sort. Consequently the user will be forced to remove the gloves for use of the bottle or container. Furthermore this is liable to result in lower levels of hydration for the user given the inconvenience of using the bottle, as well as transporting it.

The present invention arose in order to overcome problems suffered by existing devices.

With reference to FIGS. 8-13 there is shown an embodiment of the device 199 generally comprising container carriage device 102 comprising a container, and a carrier, wherein the carrier is arranged to extend from one or more securement locations on the side of the container 102 and one or more securement locations is arranged to enable the container to rotate with reference to the carrier.

The carrier in the pictured embodiment includes a strap 101.

The strap is relatively rigid laterally and longitudinally so as to provide a rigid U template for placing around a large circumference item such as the boxing glove.

The strap is secured to the container at the pivot means or pivots 103 so as to allow rotation of the carrier around the container 102. The container comprises an elongate bottle with an indentation in one side, and a carrier channel in the other side.

In particular reference to the pictured embodiment the embodiment comprises a bottle container 102.

This bottle 102 comprises a thermoplastics bottle in transparent or partly opaque material, so as to allow viewing of the contents. The material may comprise polyethylene or similar.

The bottle comprises a top 104 and a bottom 109. The bottom is substantially flat, and the top comprises a displaceable lid 105. The bottle narrows at the indentation in profile, so as to provide a narrower profile for gripping by a boxing glove. The base is widened to provide greater stability.

The bottle comprises an overmould sleeve 108 in the indentation in an elastomer such as silicone, so as to aid in holding, particularly increasing friction against a boxing glove surface. The overmould comprises raised and lowered parts to provide friction.

The carrier comprises an elongate U-shaped strap 101 formed in a substantially inelastic flexible plastics material extending from two ends arranged to be inserted into a base 131, which base 131 comprises a U-shaped thermoplastics clip with pivots 103 at either end. The strap 101 comprises plural indications 111 on one face extending along a length from the ends.

These indications relate to boxing glove sizing so as to set the carrier for an appropriate sizing before use.

The base 131 snapfits onto the bottle, sitting securely in a semi-circular channel 113 in the bottle. In this way the base 131 is supported and held within this channel 113.

The pivots 103 are attached to the clip 131 by two push fit pins to allow flexibility in the clip whilst stopping the pivots from moving.

The pivot is pivoted on a central axis aligned to the centre of the bottle when the clip is fitted for an even centre of gravity.

A spring ball plunger holds a pivot ratchet in position and will only retract when enough turning force is applied such that it will hold the bottle in position when it is being drunk from.

The spring ball plunger pushes into holes in the pivot space every 90 degrees to allow the strap to sit securely in four different positions.

The ratchet slots into the ridges in the strap, securely holding the strap at different heights.

The strap 101 is lateral loops 107 by the pivots 103.

On the reverse face the straps 101 comprise a laterally serrated face 110 to provide an engagement fit with the pivots 103.

The carrier is thereby enabled to pivot on the pivots through at least 90 degrees, such that the carrier may extend orthogonally from the axis of the container, and/or extend axially from the container in a second position.

The bottle has a lid 104 formed of screw top 105 formed of an opaque and/or coloured plastics material, such as acrylonitrile butadiene styrene (ABS). The lid has a pop-up spout 106 so as to be operable without hands.

In use the user will:

Pick the bottle up by hooking the strap under the rim of their glove with the strap.

Push on the base of the bottle to turn it 90 degrees, this will stay in place once it has turned. In this way the carrier is on the opposite side of the bottle to the channel, and opposing the indentation and grip sleeve.

Lift the bottle to the mouth to drink, the valve will ensure the bottle is watertight until it is drunk from.

When the user has finished drinking s/he may be able to easily rotate the carrier through 90 degrees so as to allow the embodiment to be placed on a flat surface ready for later usage.

The invention has been described by way of examples only and it will be appreciated that variation may be made to the above-mentioned embodiments without departing from the scope of invention as defined by the appended claims.

The following clauses recite features the invention the may or may not presently be claimed, but which may serve as basis for a future amendment or divisional application:

1. A container carriage device comprising a container, and a carrier, wherein the carrier is arranged to extend from one or more securement locations on the side of the container and one or more securement locations is arranged to enable the container to rotate with reference to the carrier.

2. A device according to clause 1 wherein the container is a thermoplastics bottle.

3. A device according to clause 1 or 2 wherein the container comprises a grip sleeve.

4. A device according to any preceding clause wherein the container comprises a lid with a suction valve.

5. A device according to any preceding clause wherein the carrier comprises a strap.

6. A device according to clause 5 wherein the strap is inelastic.

7. A device according to clause 5 or 6 wherein the strap comprises adjustment means.

8. A device according to clause 7 wherein the adjustment means comprises indications relating to boxing glove sizes.

9. A device according to any preceding clause wherein the container comprises a channel for receipt of a base for the carrier.

10. A device according to clause 9 wherein the channel is on an opposing side to the container of an indentation arranged for receipt of a boxing glove.

11. A device according to clause 10 wherein the indentation is provided with a grip surface.

12. A carrier for a device according to any of the preceding clauses.

13. A container for a device according to any of the preceding clauses 1 to 11.

The invention claimed is:

1. A method of drinking from a drinking bottle by a user wearing boxing gloves, the drinking bottle comprising: a container for containing liquid therein; a handle for lifting the container; and first and second coupling mechanisms rotatably coupling the handle to the container; wherein the first and second coupling mechanisms are arranged to permit rotation of the handle relative to the container between a first position in which the handle extends above the container, and a second position in which the handle is rotated to extend out to a side of the container; and wherein the handle is formed of a resilient material and is arranged to substantially maintain a handle shape during use so that the container depends or hangs from a distal end of the handle, the method comprising:

gripping the handle of the drinking bottle and lifting the drinking bottle thereby while the user is wearing the boxing gloves, wherein the handle is a loop large enough to receive a boxing glove of the boxing gloves therein, the handle comprises a first end portion and a second end portion that opposes the first end portion, the first end portion is configured to be attached to the first coupling mechanism at a first location on the container, and the second end portion is configured to be attached to the second coupling mechanism at a second location on the container that is diametrically opposed to the first location;

rotating the handle relative to the container of the drinking bottle from the first position to the second position, wherein the rotating occurs during the lifting of the drinking bottle due to a weight of the drinking bottle and without further intervention of the user to cause rotation;

tipping the container using the handle in the second position; and drinking a liquid from the container.

2. A method as claimed in claim 1, wherein gripping the handle to lift the drinking bottle comprises orienting a palm of the user in an upward direction.

3. The method as claimed in claim 1, wherein the first and second coupling mechanisms prevent the handle from performing a complete revolution.

* * * * *